United States Patent [19]

Glazer

[11] 4,048,748

[45] Sept. 20, 1977

[54] COLLAPSIBLE DOLL HOUSE

[76] Inventor: Patti Glazer, 3101 Cummings Lane, Chevy Chase, Md. 20015

[21] Appl. No.: 706,825

[22] Filed: July 19, 1976

[51] Int. Cl.[2] ..... A63H 33/00

[52] U.S. Cl. ..... 46/12; 35/16; 272/2

[58] Field of Search ..... 46/87, 1 L, 12, 13, 46/16, 19; 272/2; 35/16; 135/5 R, 3 E, 8; 52/63, 83

[56] References Cited

U.S. PATENT DOCUMENTS

| | | | |
|---|---|---|---|
| 3,498,305 | 3/1970 | Hulin | 135/1 |
| 3,908,304 | 9/1975 | Crahan et al. | 46/12 |

*Primary Examiner*—Jay N. Eskovitz
*Assistant Examiner*—Mickey Yu
*Attorney, Agent, or Firm*—Kurt Kelman

[57] ABSTRACT

A collapsible multi-level doll house comprises two or more levels each comprising a rigid stiffening member defining a horizontal plane, a floor in the plane, and collapsible walls of fabric having a lower end attached to the floor. The upper end of the walls is attached to the floor of the next higher level to define rooms, the upper ends of the roof level meeting at an apex. Pull strings are attached to the apex and release thereof causes the walls to collapse between the floors whereby the floors of the doll house are stacked in adjoining relationship, with the collapsed fabric walls flattened therebetween.

6 Claims, 3 Drawing Figures

COLLAPSIBLE DOLL HOUSE

The present invention relates to a collapsible multi-level doll house.

It is an object of this invention to provide a doll house of any desired configuration and number of levels, made in a very simple manner from inexpensive and readily available materials. It is a concomitant object of the invention to make such a doll house collapsible so that it may be stored or transported in a confined space while it may be readily erected to form a relatively large structure.

The above and other objects are accomplished in accordance with the present invention with a collapsible multi-level doll house which includes a ground level and a roof level. Each but the roof level comprises a substantially rigid stiffening member defining a horizontal plane, a floor in the plane, and collapsible walls of pliable sheet material having a lower end attached to the floor and an upper end attached to the floor of the next higher level. The collapsible walls and floors define rooms. The roof level comprises a substantially rigid stiffening member defining a horizontal plane, a floor in the plane, and collapsible walls of pliable sheet material having a lower end attached to the floor of the roof level, the upper ends of the collapsible walls of the roof level meeting at an apex. Suspension means is attached to the apex of the collapsible walls of the roof level. Release of the suspension means causes the walls to collapse between the floor whereby the floors of the doll house are stacked in adjoining relationship, with the collapsed pliable sheet material walls flattened therebetween.

The above and other objects, advantages and features of this invention will become more apparent from the following detailed description of one specific embodiment, taken in conjunction with the accompanying drawing wherein FIG. 1 shows a collapsible doll house according to the invention in the erected state;

Figure 1:
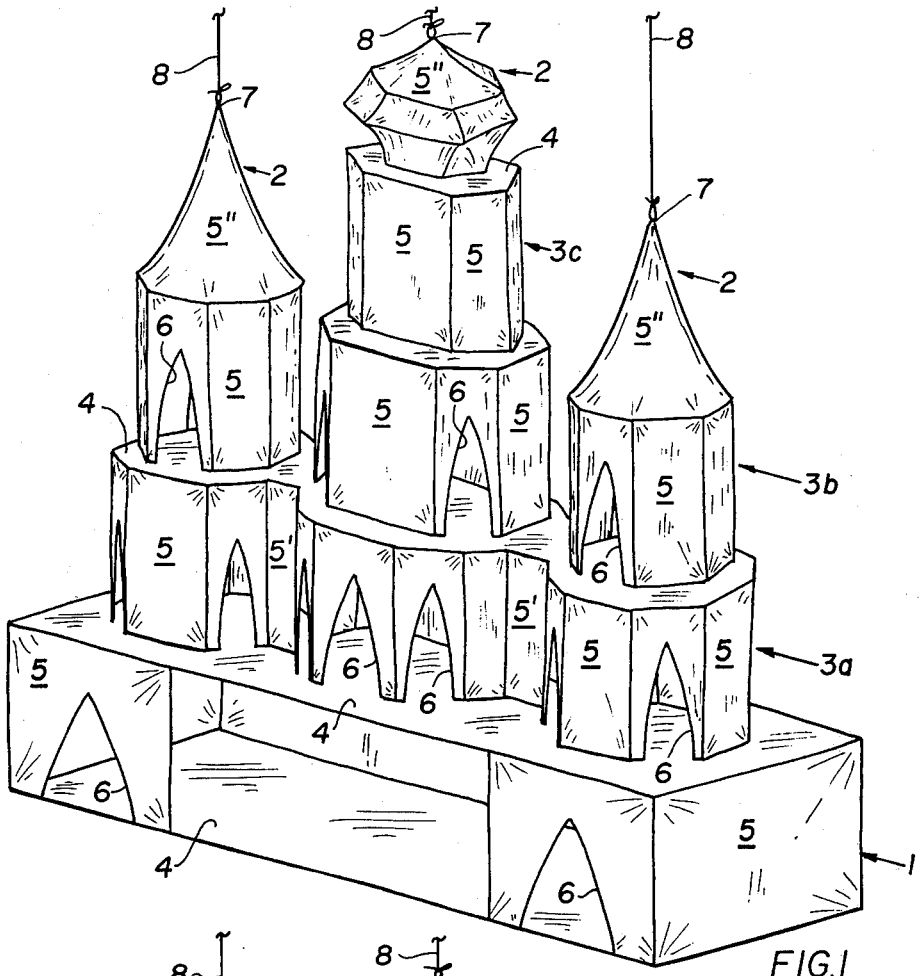

Referring now to the drawing, the multi-level doll house is shown to include ground level 1, roof level 2 and intermediate levels 3*a*, 3*b*, 3*c*. Obviously, any number of levels may be provided. Each but the roof level comprises a substantially rigid, i.e. shape-retaining, stiffening member 4 defining a horizontal plane and a floor in the plane. In the illustrated embodiment, the stiffening member is an essentially planar board, for instance a fabric-covered synthetic resin board, which forms the floor. However, it would be possible to constitute the stiffening member by a shape-retaining frame covered with fabric, for instance, to form the floor. If desired, the fabric cover may be provided with zippers to enable the stiffening member to be removed so that the remaining collapsed fabric shell of the doll house may be washed. Collapsible walls 5 of pliable sheet material, such as a fabric, have a lower end attached to the floor and an upper end attached to the floor of the next higher level. In the illustrated embodiment, some of the walls have doorways 6 cut out. Obviously, windows and/or other openings may be provided in any of the walls. The collapsible walls are shaped to define rooms with the floors to which they are attached.

In the illustrated embodiment, a large ground level supports three multi-level towers, each tower being comprised of ascending levels of diminishing floor area. As shown, the second levels of the towers are interconnected by collapsible cross walls 5' consisting of fabric webs. However, all levels of the doll house may be of unitary structure, like the illustrated ground level, and of the same area or of different areas. On the other hand, more or less than three tower structures may be mounted on the ground level.

Figure 2:
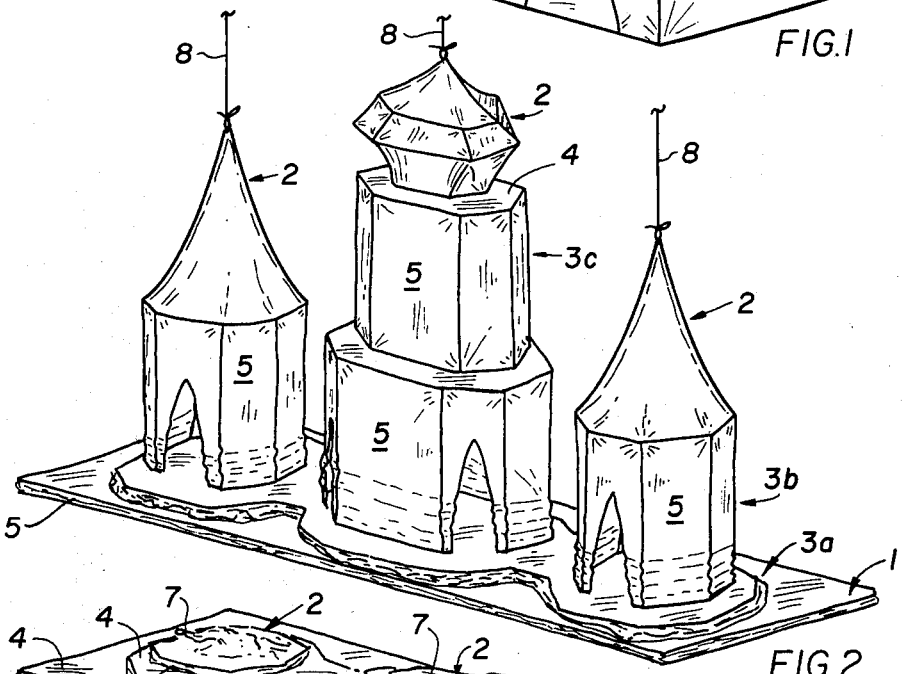
FIG. 2 shows the doll house of FIG. 1 partially collapsed.
Figure 3:
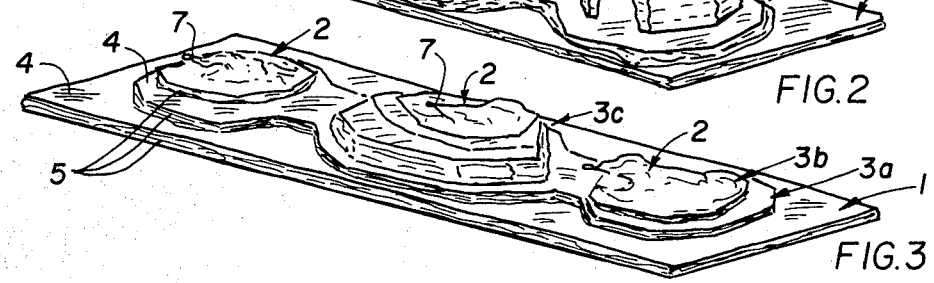
FIG. 3 shows the completely collapsed and flattened doll house.

Roof level 2 comprises collapsible walls 5'' of pliable sheet material, such as fabric, having a lower end attached either to floor 4 interposed between walls 5'' and 5 or to wall 5 alone. The upper ends of collapsible walls 5'' meet at apex 7 and pull string 8 is attached to the apex. This pull string constitutes a suspension means whose release causes walls 5, 5', 5'' to collapse between the floors whereby the floor of the doll house are stacked in adjoining relationship, with the collapsed pliable sheet material walls flattened therebetween as shown in FIG. 3. FIG. 2 shows an intermediate step in the collapse of the doll house.

When it is desired to maintain the doll house in its erected state, the upper ends of elongated flexible tensile elements 8 may be attached to a beam mounted above the doll house. This beam could support pulleys over which the pull strings are trained for pulling the strings up and to erect the house. Upon release, the structure will collapse and may be stored or transported flat.

Innumerable structural shapes may be produced merely by patterning the pliable wall sheet material suitably to make rooms of polygonal or curvilinear cross sections. Suitable sheet material sections may then simply be sewn together and sewn to the sheet material covered floors, the latter consisting of synthetic resin or like boards to make an inexpensive doll house of any desired structure. Additional sections could be added at will by means of zippers, buttons or snaps mounted on the pliable sheet material.

What is claimed is:

1. A collapsible multi-level doll house including a ground level and a roof level, each but the roof level comprising a substantially rigid stiffening member defining a horizontal plane, a floor in said plane, and collapsible walls of pliable sheet material having a lower end attached to the floor and an upper end attached to the floor of the next higher level, the collapsible walls and floors defining rooms, the roof level comprising a substantially rigid stiffening member definging a horizontal plane, a floor in said plane, and collapsible walls of pliable sheet material having a lower end attached to the floor of the roof level, the upper ends of the collapsible walls of the roof level meeting at an apex, and suspension means attached to the apex of the collapsible walls of the roof level, release of the suspension means causing the walls to collapse between the floors whereby the floors of the doll house are stacked in adjoining relationship, with the collapsed pliable sheet material walls flattened therebetween.

2. The collapsible multi-level doll house of claim 1, wherein the stiffening members are essentially planar boards.

3. The collapsible multi-level doll house of claim 1, wherein the pliable sheet material is a fabric.

4. The collapsible multi-level doll house of claim 1, wherein the suspension means comprises an elongated flexible tensile element.

5. The collapsible multi-level doll house of claim 4, wherein the tensile element is a pull string.

6. The collapsible multi-level doll house of claim 1, wherein at least some of the levels comprise a plurality of separate and horizontally aligned ones of the stiffening members together defining the horizontal plane, a like plurality of separate floors in said plane, and the collapsible walls being attached to the separate floors.

* * * * *